US007506416B2

(12) United States Patent
Hoffman et al.

(10) Patent No.: US 7,506,416 B2
(45) Date of Patent: Mar. 24, 2009

(54) CLOSURE ASSEMBLY AND SLIDER THEREFORE

(75) Inventors: Jeffrey S. Hoffman, Linwood, MI (US); Bryan L. Ackerman, Freeland, MI (US); Heath A. Doty, St. Louis, MO (US); Melvin Joshua Leedle, St. Louis, MO (US); Marissa A.K. Schultz, Racine, WI (US); Robert R. Turvey, Sanford, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 372 days.

(21) Appl. No.: 11/440,522

(22) Filed: May 25, 2006

(65) Prior Publication Data

US 2006/0265842 A1 Nov. 30, 2006

Related U.S. Application Data

(60) Provisional application No. 60/684,943, filed on May 26, 2005.

(51) Int. Cl.
*A44B 19/26* (2006.01)

(52) U.S. Cl. ..... 24/417; 24/399; 24/400; 24/416; 24/427

(58) Field of Classification Search ..... None
See application file for complete search history.

(56) References Cited

U.S. PATENT DOCUMENTS

| | | | | |
|---|---|---|---|---|
| 1,666,110 | A | 4/1928 | Statham | |
| 2,867,877 | A | 1/1959 | Staller et al. | |
| 2,875,491 | A | 3/1959 | Morin | |
| 2,929,123 | A | 3/1960 | Schneideman | |
| 3,074,137 | A | 1/1963 | Hawley | |
| 3,103,049 | A | 9/1963 | Hawley | |
| 3,115,689 | A | 12/1963 | Jacobs | |
| 3,122,807 | A | 3/1964 | Ausnit | |
| 3,173,184 | A | 3/1965 | Ausnit | |
| 3,220,076 | A | 11/1965 | Ausnit et al. | |
| 3,324,520 | A | 6/1967 | Ausnit | |
| 3,426,396 | A | 2/1969 | Laguerre | |
| 3,660,875 | A | 5/1972 | Gutman | |
| 3,713,923 | A | 1/1973 | LaGuerre | |
| 3,806,998 | A | 4/1974 | LaGuerre | |
| 3,959,856 | A | 6/1976 | Ausnit | |
| 4,262,395 | A * | 4/1981 | Kosky | 24/400 |

(Continued)

FOREIGN PATENT DOCUMENTS

| | | |
|---|---|---|
| EP | 0 051 010 | 5/1982 |

(Continued)

*Primary Examiner*—Jacky W. Lavinder

(57) ABSTRACT

A closure assembly includes a slider for opening and/or closing an elongate closure mechanism including a pair of opposing closure members. The slider includes a first separator finger and a second separator finger, each of which is articulably connected to a hinge member. The first and second separator fingers extend between the closure members and may be articulated between a closing position, in which the separator fingers are adjacent each other, and an opening position, in which the separator fingers are laterally spaced from each other. In the opening position, the separator fingers urge the members apart. Closing bars and retention members may also be included to facilitate re-closing the closure members and retaining the slider in an operative position thereon.

20 Claims, 2 Drawing Sheets

U.S. PATENT DOCUMENTS

| | | | |
|---|---|---|---|
| 4,513,484 | A | 4/1985 | Iblings |
| 4,541,117 | A | 9/1985 | Ashbeck |
| 4,922,586 | A | 5/1990 | Robson |
| 4,944,072 | A | 7/1990 | Robson |
| 5,007,142 | A | 4/1991 | Herrington |
| 5,007,143 | A | 4/1991 | Herrington |
| 5,010,627 | A | 4/1991 | Herrington et al. |
| 5,020,194 | A | 6/1991 | Herrington et al. |
| 5,063,644 | A | 11/1991 | Herrington et al. |
| 5,067,208 | A | 11/1991 | Herrington, Jr. et al. |
| 5,070,583 | A | 12/1991 | Herrington |
| 5,283,932 | A | 2/1994 | Richardson et al. |
| 5,301,394 | A | 4/1994 | Richardson et al. |
| 5,442,837 | A | 8/1995 | Morgan |
| 5,442,838 | A | 8/1995 | Richardson et al. |
| 5,448,808 | A | 9/1995 | Gross |
| 5,664,299 | A | 9/1997 | Porchia et al. |
| 5,809,621 | A | 9/1998 | McCree et al. |
| 5,867,875 | A | 2/1999 | Beck et al. |
| 5,871,281 | A | 2/1999 | Stolmeier et al. |
| 5,896,627 | A | 4/1999 | Cappel et al. |
| 5,947,603 | A | 9/1999 | Tilman |
| 5,953,796 | A | 9/1999 | McMahon et al. |
| 5,956,815 | A | 9/1999 | O'Connor et al. |
| 5,983,466 | A | 11/1999 | Petkovsek |
| 6,014,795 | A | 1/2000 | McMahon et al. |
| 6,036,364 | A | 3/2000 | Heuvel |
| 6,047,450 | A | 4/2000 | Machacek et al. |
| 6,088,887 | A | 7/2000 | Bois |
| 6,112,374 | A | 9/2000 | Van Erden |
| 6,220,754 | B1 | 4/2001 | Stiglic et al. |
| 6,257,763 | B1 | 7/2001 | Stolmeier et al. |
| 6,290,391 | B1 | 9/2001 | Buchman |
| 6,293,701 | B1 | 9/2001 | Tomic |
| 6,305,844 | B1 | 10/2001 | Bois |
| 6,361,209 | B1 | 3/2002 | LaRue et al. |
| 6,439,771 | B1 | 8/2002 | Herrington, Jr. |
| 6,477,821 | B1 | 11/2002 | Bois |
| 6,481,890 | B1 | 11/2002 | VandenHeuvel |
| 6,490,769 | B2 | 12/2002 | Siegel |
| 6,595,689 | B1 | 7/2003 | Borchardt et al. |
| 6,609,353 | B1 | 8/2003 | McMahon et al. |
| 6,609,827 | B2 | 8/2003 | Bois et al. |
| 6,611,996 | B2 | 9/2003 | Blythe et al. |
| 6,632,021 | B2 | 10/2003 | Bois et al. |
| 6,666,580 | B2 | 12/2003 | Bois |
| 6,698,926 | B2 | 3/2004 | Buchman |
| 6,733,178 | B2 | 5/2004 | Bois |
| 6,739,755 | B2 | 5/2004 | Schreiter |
| 6,755,569 | B2 | 6/2004 | Bois |
| 6,761,481 | B1 | 7/2004 | Bois |
| 6,789,947 | B1 | 9/2004 | Kasai |
| 6,817,763 | B2 | 11/2004 | Tomic |
| 6,854,887 | B2 | 2/2005 | Anderson |
| 6,874,205 | B1 | 4/2005 | Savicki |
| 6,880,972 | B2 | 4/2005 | Plourde |
| 6,883,210 | B1 | 4/2005 | Savicki |
| 6,896,409 | B2 | 5/2005 | Plourde et al. |
| 6,902,321 | B2 | 6/2005 | Bois |
| 6,915,546 | B2 | 7/2005 | Kasai |
| 6,951,421 | B2 | 10/2005 | Crunkleton et al. |
| 6,962,440 | B2 | 11/2005 | Fenzl et al. |
| 6,996,879 | B1 | 2/2006 | Savicki |
| 7,017,241 | B2 | 3/2006 | Bentsen |
| 7,036,987 | B2 | 5/2006 | Crunkleton et al. |
| 2002/0034342 | A1 | 3/2002 | Bois |
| 2002/0034344 | A1 | 3/2002 | Bois |
| 2003/0202718 | A1 | 10/2003 | Tomic |
| 2003/0217444 | A1 | 11/2003 | Blythe et al. |
| 2004/0045138 | A1 | 3/2004 | Kasai |
| 2004/0161167 | A1 | 8/2004 | Ausnit et al. |
| 2004/0161173 | A1 | 8/2004 | Linton et al. |
| 2005/0008267 | A1 | 1/2005 | Linton et al. |
| 2005/0084183 | A1 | 4/2005 | Ausnit |

FOREIGN PATENT DOCUMENTS

| | | |
|---|---|---|
| EP | 0 479 661 | 4/1992 |
| EP | 0 941 937 | 9/1999 |
| FR | 2 636 923 | 3/1990 |
| JP | 06-077518 | 11/1994 |
| JP | 08-214920 | 8/1996 |
| JP | 2000-023716 | 1/2000 |
| JP | 2000-152810 | 6/2000 |
| JP | 2004-161305 | 6/2004 |
| WO | WO 91/13759 | 9/1991 |
| WO | WO 92/17084 | 10/1992 |
| WO | WO 92/17086 | 10/1992 |
| WO | WO 92/19450 | 11/1992 |
| WO | WO 92/20252 | 11/1992 |

* cited by examiner

CLOSURE ASSEMBLY AND SLIDER THEREFORE

CROSS REFERENCE TO RELATED APPLICATIONS

This application claims the benefit of U.S. Provisional Patent Application No. 60/684,943, filed May 26, 2005, which is incorporated by reference in its entirety herein.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a closure assembly including an elongate closure mechanism and a slider having an articulating separator member.

2. Description of the Background of the Invention

Closure mechanisms that include a slider for occluding and de-occluding one or more pairs of opposing interlocking profiles are known. The slider facilitates relatively easy opening and closing of the interlocking profiles. A difficulty with such closure mechanisms, however, is preventing leakage around a separating member when the slider is disposed in a fully closed position on the interlocking profiles.

In one instance, a slider includes a separator finger that extends only between an upper pair of opposing interlocking profiles so that the slider does not separate a lower pair of opposing interlocking profiles. When slid along the closure mechanism in an opening direction, the slider only opens the upper pair of opposing interlocking profiles. A user then manually opens the lower pair of opposing interlocking profiles, such as by pulling the profiles apart. When slid along the closure mechanism in a closing direction, the slider includes projections that are adapted to cause the upper and lower pairs of opposing interlocking profiles to move together and engage mutually.

In another instance, a slider for a closure mechanism having upper and lower pairs of opposing interlocking profiles has an opening plow that separates the upper and lower pairs of interlocking profiles when slid in an opening direction along the closure mechanism. The plow is a vertical member depending from a top wall of the slider and a horizontal member extending laterally from a lower end of the vertical member outwardly toward left and right sidewalls of the slider between the upper and lower interlocking profiles. The horizontal member presses against a backing member extending between the upper and lower interlocking profiles to separate the interlocking profiles without having the vertical member engage the interlocking profiles.

SUMMARY OF THE INVENTION

In one aspect of the invention, a slider mechanism for opening a closure mechanism having a pair of opposing elongate closure members includes a separator member centrally disposed in a longitudinal channel adapted to receive the closure members therein. The separator member has a first separator portion and a second separator portion. The slider mechanism also includes a hinge member and an actuation lever. The first separator portion is articulable toward and away from the second separator portion about the hinge member. Further, the actuating lever articulates the first separator portion away from the separator portion when engaged in the opening direction.

In another aspect of the invention, a closure mechanism includes a first elongate closure member opposing a second elongate closure member complementary to the first elongate closure member and a slider. The slider includes a first separator portion and a second separator portion articulably separable from the first separator portion about an axis that is about perpendicular to an axis of the elongate closure members. The first separator portion and the second separator portion are disposed between the first elongate closure member and the second elongate closure member. The slider de-occludes the first elongate closure member from the second elongate closure member when urged in a first direction.

Other aspects of the present invention will become apparent upon consideration of the following detailed description.

DETAILED DESCRIPTION

Figure 1:
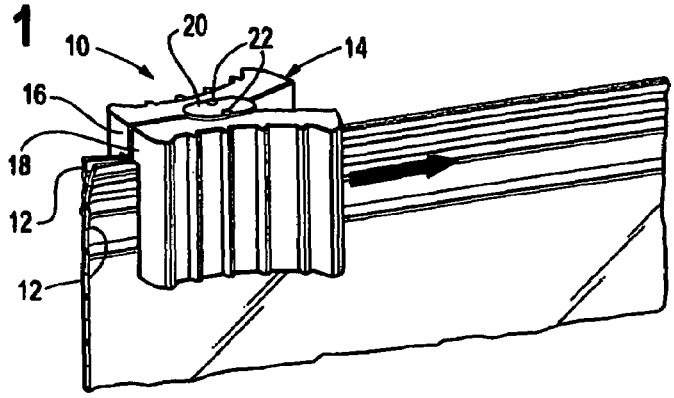
FIG. 1 is a partial isometric view of a closure assembly according to a first embodiment of the invention.
Figure 2:
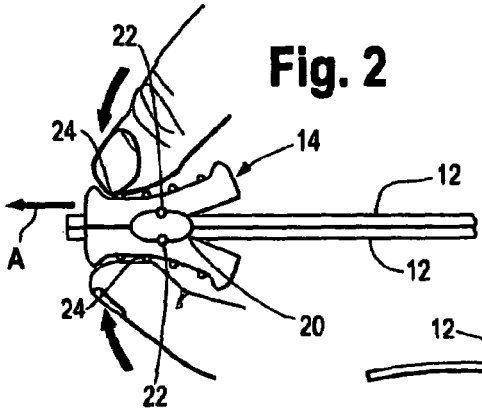
FIG. 2 is a partial plan view of the closure assembly of FIG. 1 in a closing position.
Figure 3:
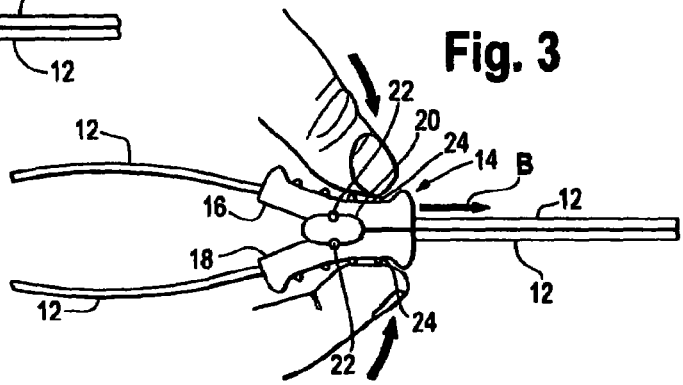
FIG. 3 is a partial plan view of the closure assembly of FIG. 1 in an opening position.

Turning now to the drawings, FIGS. 1-3 show a first embodiment of a closure assembly 10 including an elongate closure mechanism having complementary opposing elongate closure members 12 and a slider 14 for separating the closure members. The slider 14 includes a first separator finger 16 and a second separator finger 18, each disposed between the closure members. The first separator finger 16 and the second separator finger 18 are articulable around a hinge member 20 between a closing position, as shown in FIG. 2, and an opening position, as shown in FIG. 3. In the closing position, the first separator finger 16 is disposed laterally adjacent to or overlapping with the second separator finger 18. In the opening position, the first separator finger 16 is laterally spaced away from the second separator finger 18, thereby holding the closure members 12 apart from each other.

Each of the first and second separator fingers 16, 18 is connected to an outwardly flared sidewall 24, which is connected to the centrally disposed hinge member 20 by hinges 22 disposed medially along the outwardly flared sidewall 24. Each of the hinges 22 has an axis that is approximately perpendicular to an axis of the elongate closure members 12, which allows each outwardly flared sidewall 24 and the respective separator finger 16, 18 to articulate laterally horizontally about a vertically oriented axis. (All relational terms, such as lateral, horizontal, vertical, etc, are in relation to the orientation of the drawings, and are not meant to be limited thereto.) The outwardly flared sidewalls 24 act as levers about the hinges 22 to both separate and bring together the first and second separator fingers 16, 18 depending on what direction the outwardly flared sidewalls are urged about the hinge. For example, if a user grasps the slider 14 between a thumb and finger and urges the slider in a closing direction toward the separator fingers 16, 18 as shown by the arrow A in FIG. 2, the separator fingers are urged laterally together toward the closing position around the hinges 22 as the slider is shifted along the closure members 12 in the closing direction, thereby allowing occlusion of the closure members. On the other hand, if the user urges the slider 14 in an opposite, opening direction away from the separator fingers 16, 18, as shown by the arrow B in FIG. 3, using the thumb and finger, the separator fingers 16, 18 are urged laterally apart toward the opening position around the hinges 22 as the slider is shifted along the closure members 12 in the opening direction, thereby de-occluding the closure members.

The slider 14 may be adapted to open many different types of complementary opposing elongate closure members. For example, in one embodiment, the slider 14 is adapted to open a pair of opposing closure members, each having upper and lower elongate interlocking profiles. In another embodiment, the slider is adapted to open a pair of opposing closure members, each having only a single elongate interlocking profile. In yet another embodiment, the slider is adapted to open a pair of opposing closure members, each having an elongate array of non-elongate interlocking members. The slider may also be adapted to occlude the opposing closure members when urged in the closing direction by, for example, having a channel defining a narrow gap that urges the opposing interlocking members or interlocking profiles together into an interlocking relationship.

Figure 4:
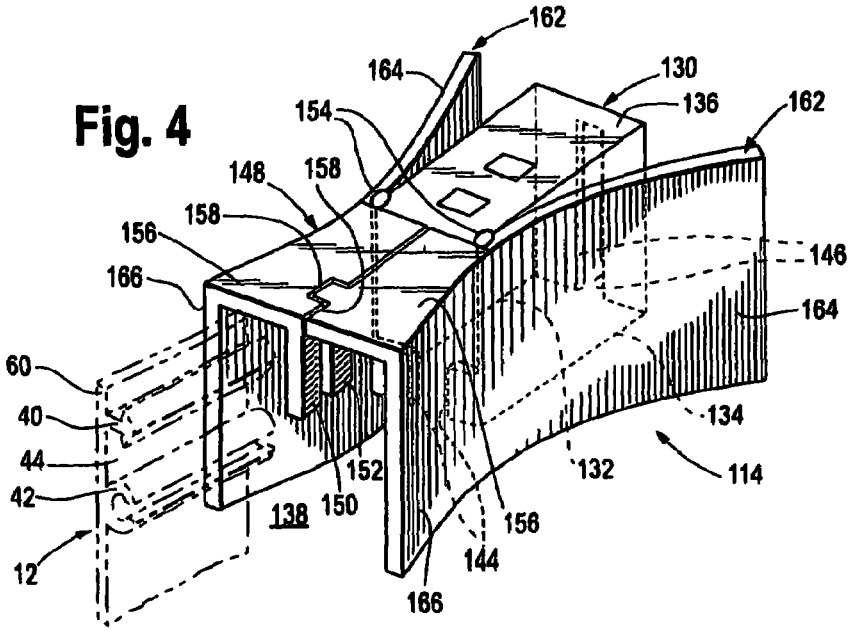
FIG. 4 is an isometric view of a slider according to another embodiment of the invention.

In FIG. 4, another embodiment of a slider 114 for a closure assembly, such as 10, is shown having a separator including first and second separator members that are articulable about vertically oriented axes between a closing position and an opening position in a similar manner as the slider 14 shown in FIG. 1. Specifically, a channel member 130, including a left channel wall 132 and a right channel wall 134 depending downwardly from a top channel wall 136, defines a longitudinal channel 138, which is sized to receive a pair of opposing elongate closure members 12 (partially shown in dashed lines) therein. In one embodiment, each closure member 12 includes an upper interlocking profile 40 spaced from a lower interlocking profile 42 and defining a gap 44 therebetween. A pair of opposing protrusions, such as lower front closing bars 144, extend into the channel 138 from the left and right channel walls 132, 134 to occlude the lower interlocking profiles 42 when passed therebetween. The lower front closing bars 144 are spaced from the top channel wall 136 to be aligned only with the lower interlocking profiles 42. A pair of opposing protrusions, such as rear closuring bars 146, longitudinally spaced from the lower front closing bars 144 extends into the channel from the left and right channel walls 132, 134. The rear closing bars 146 are aligned with the upper interlocking profiles 40 and the lower interlocking profiles 42 to occlude both the upper and lower interlocking profiles when passed therebetween.

A separator member 148 extending longitudinally beyond an opening end of the channel member 130 further defines the channel 138 and includes a left separator finger 150 and a right separator finger 152 that extend downwardly into a central portion of the channel so as to be disposed between the opposing closure members 12. Each of the left separator finger 150 and the right separator finger 152 is articulably attached, such as with a vertical hinge 154, to the channel member 130 via an intermediate member 156, such as a wall portion. The left and right separator fingers 150, 152 may be articulated about the respective hinges 154 between a closed position, in which the left and right separator fingers are adjacent each other as shown in FIG. 4, and an open position, in which the left and right separator fingers are laterally spaced from each other. The right separator finger 152 is longitudinally displaced between the left separator finger 150 and the channel member 130 such that the left separator finger laterally overlaps with the right separator finger in the closed position. Each of the left and right separator fingers 150, 152 seats within a notch 158 in the opposing intermediate member 156, thereby allowing the left and right separator fingers to be longitudinally aligned in the closed position. Each of the left and right separator fingers 150, 152 extends downwardly from the respective intermediate member 156 a distance sufficient to separate the opposing closure members 12. In one embodiment, the left and right separator fingers 150, 152 extend downwardly between only the upper interlocking profiles 40. In another embodiment, the left and right separator fingers 150, 152 extend downwardly between all the opposing interlocking profiles of the opposing closure members 12, and in a further embodiment, the left and right separator fingers extend only between an upper flange 60 extending between the upper interlocking profiles 40 and the intermediate members 156. In any of these embodiments, the left and right separator fingers 150, 152 at least partially de-occlude, or separate, the opposing closure members 12 by urging the opposing closure members apart when the left and right separator fingers are laterally articulated away from each other toward the opening position.

A lever actuator 162 is connected to each of the left separator finger 150 and the right separator finger 152 to facilitate articulating the left and right separator fingers between the opening position and the closing position. In one embodiment, each lever actuator 162 includes a rear wall portion 164 extending from the respective intermediate portion 156 past the hinge 154 and spaced from the channel member 130, such as by bowing outwardly therefrom, such that the lever actuators may be urged together in a first location to articulate the left and right separator fingers toward the opening position. Each lever actuator 162 also includes a front wall portion 166 extending coincident with the respective intermediate member 156 and spaced from the channel 138, such as by bowing outwardly therefrom, so that the lever actuators may be urged together in a second location to articulate the left and right separator fingers 150, 152 toward the closing position. For example, when a user grips the slider 114 between a thumb and forefinger and urges the slider in an opening direction toward the rear closing bars 146, the lever actuators 162 are urged laterally together toward the closure members 12 at the rear wall portions 164, thereby articulating the left and right separator fingers 150, 152 horizontally laterally apart in an opposite direction about the vertical axes of the hinges 154 toward the opening position. When the user urges the slider 14 in a closing direction toward the separator member 148, the lever actuators 162 are urged together at the front wall portions 166, thereby articulating the left and right separator fingers 150, 152 horizontally laterally together about the respective hinges 154 toward the closing position.

Figure 5:
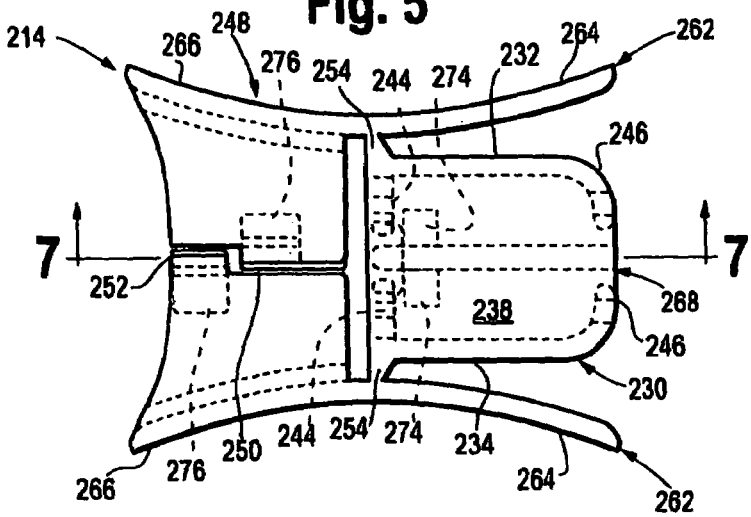
FIG. 5 is a plan view of a slider according to a further embodiment of the invention.
Figure 6:
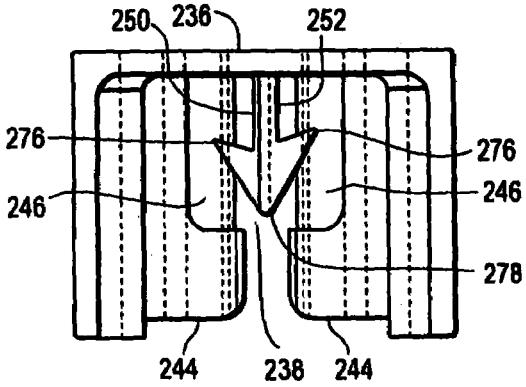
FIG. 6 is a front elevational view of the slider shown in FIG. 5.
Figure 7:
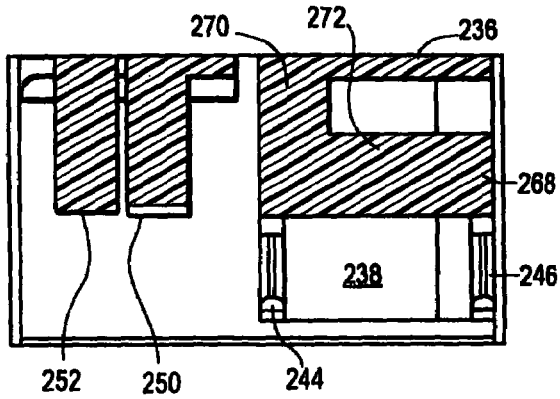
FIG. 7 is a cross-sectional view of the slider shown in FIG. 5 as seen along the lines 7-7.

FIGS. 5-7 show a further embodiment of a slider 214 for an elongate closure mechanism similar to the slider 114 shown in FIG. 4, except that retention features are also included to help retain the slider in an operative position on the opposing closure members 12. The slider 214 includes a channel member 230 having a left channel wall 232 and a right channel wall 234 depending from a top channel wall 236 and defining a longitudinal channel 238, which accepts a pair of opposing horizontally elongate closure members, such as 12 (shown in FIG. 4), each having an upper interlocking profile 40 spaced from a lower interlocking profile 42, therein. The channel member 230 further includes lower front closing bars 244 longitudinally spaced from rear closing bars 246. The lower front closing bars 244 are spaced from the top channel wall 236 and aligned to occlude the lower interlocking profiles 42 therebetween. The rear closing bars 246 are aligned to occlude the upper and lower interlocking profiles 40, 42 therebetween. A separator member 248 having left and right separator fingers 250, 252, each articulatingly attached to the channel member at a vertically oriented hinge 254, further defines the channel 238 and is disposed beyond an end of the channel member 230 with the left and right separator fingers centrally disposed in the channel. The right separator finger 252 is longitudinally displaced between the left separator finger 252 and the channel member 230 such that the left and right separator fingers laterally overlap and align in the closing position. A lever actuator 262 having an outwardly flared front wall section 266 and an outwardly flared rear wall section 264 is connected to each of the left and right separator fingers 250, 252 to facilitate articulating the left and right separator fingers between the opening position and the closing position depending on which direction a user is sliding the slider 214 along the opposing closure members 12. When the rear wall sections 264 are urged together in a first direction toward the channel 238, the separator fingers 250, 252 are urged apart in a second direction opposite the first direction about the respective hinges 254. Conversely, when the front wall sections 266 are urged together in the first direction toward the channel 238, the separator fingers 250, 252 articulate together in the first direction and the rear wall sections 264 articulate apart in the second direction about the respective hinges 254.

The slider 214 also includes a retention member 268, which is disposed between the opposing closure members 12 and engages the upper and/or lower interlocking members 40, 42 between the retention member and the upper channel wall 236. In one embodiment, the retention member 268 includes an arm 270 extending downwardly from the top channel wall 236 spaced between the left channel wall 232 and the right channel wall 234 proximate the lower front closing bars 244. A tail portion 272 spaced from the top channel wall 236 extends longitudinally between the arm 270 and the rear closing bars 246. A horizontal member, such as a lateral shoulder 274 or step, is disposed on each opposite side of the arm 270. The lateral shoulders 274 and the tail portion 272 are disposed to fit in the gap 44 between the upper and lower interlocking profiles 40 and 42 of the opposing closure members 12 such that the shoulders and the tail portion engage an underside of the upper interlocking profiles when the slider 214 is operatively disposed thereon. In addition, each of the left and right separator fingers 250, 252 includes a lateral shoulder 276 extending outwardly toward the left and right sides of the channel 238, respectively. The lateral shoulders 276 are disposed to slidingly abut the underside of the upper interlocking profiles 40 in order to retain the slider operatively disposed on the opposing closure members 12. Each of the lateral shoulders 274 and 276 has a tapered bottom end 278. In another embodiment (not shown), the tail portion 272 and the lateral shoulders 274 and 276 are disposed to receive more than one opposing pair of interlocking members, such as 40 and 42, between the top channel wall 236 and the tail portion and lateral shoulders. In a further embodiment, the tail portion 272 and the lateral shoulders 274, 276 are disposed between the upper interlocking profiles 40 and an elongate ridge (not shown) that is disposed on at least one of the upper flanges 60 of the opposing closure members 12 between the upper interlocking profile and the top channel wall 236. The lateral shoulders 276 are inclined upwardly to hook under the respective upper interlocking profiles 40.

Figure 8:
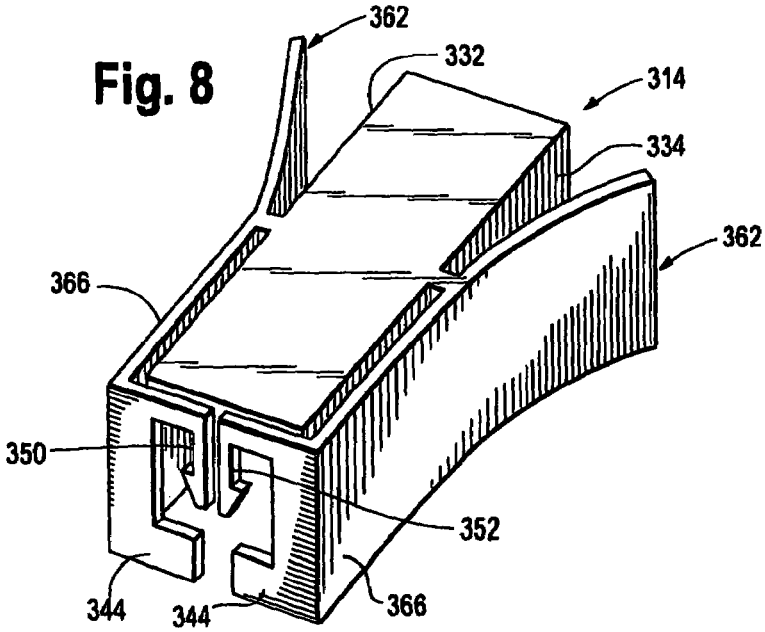
FIG. 8 is an isometric view of a slider according to yet another embodiment of the invention.

In FIG. 8, yet another embodiment of a slider 314 for a closure assembly is shown, which is similar to the slider 214 shown in FIGS. 5-7, except that lower front closure bars 344 depend from a front wall section 366 of each lever actuator 362 longitudinally aligned with left and right separator fingers 350 and 352 rather than depending from left and right channel sidewalls 332 and 334. In addition, the left separator finger 350 is laterally aligned with the right separator finger 352 such that the left separator finger does not laterally overlap with the right separator finger in the closing position. Other elements of the slider 314 are similar to those described above with respect to the previously described embodiments. Accordingly, details of the construction of those elements are omitted.

The sliders and closure mechanisms of the above-described embodiments may be made of any material suitable for providing a relatively resilient slider and a relatively flexible closure mechanism. In one embodiment, the sliders are molded of relatively stiff or rigid polymeric material, and the closure mechanisms are extruded with a more pliable polymeric resin.

INDUSTRIAL APPLICABILITY

The closure mechanism and the slider described herein provide a closure assembly for sealing, opening, and resealing a pouch for storing products therein and may be particularly well suited for reducing or eliminating leaks through gaps around the separator finger of the slider. Of course, the closure mechanism and slider may be used for sealing and resealing openings of almost any kind.

Each patent and reference cited herein is incorporated herein by reference herein. Numerous modifications to the present invention will be apparent to those skilled in the art in view of the foregoing description. Accordingly, this description is to be construed as illustrative only and is presented for the purpose of enabling those skilled in the art to make and use the sliders and closure mechanisms of the present invention and to teach the best mode of carrying out same.

We claim:

1. A slider mechanism for opening at least two opposing elongate closure members when engaged in an opening direction thereon, the slider mechanism comprising:

a separator member centrally disposed in a longitudinal channel adapted to receive the closure members therein, the separator member having a first separator portion and a second separator portion;

a hinge member; and an actuating lever;

wherein the first separator portion is articulable toward and away from the second separator portion about the hinge member, and wherein the actuating lever articulates the first separator portion away from the second separator portion when engaged in the opening direction.

2. The slider mechanism of claim 1, wherein the first separator portion articulates about an axis that is about perpendicular to the elongate closure members.

3. The slider mechanism of claim 1, wherein the actuating lever articulates the first separator portion toward the second separator portion when engaged in a closing direction opposite the opening direction.

4. The slider mechanism of claim 1 further comprising a retention member centrally disposed in the channel longitudinally spaced from the separator member.

5. The slider mechanism of claim 4, wherein the retention member depends from a top wall and includes a lateral shoulder and a longitudinal tail member extending therefrom, the lateral shoulder and the longitudinal tail member each spaced from the top wall.

6. The slider mechanism of claim 5 further comprising a first closure bar protruding laterally inwardly into the channel from a side thereof and disposed between the retention member and a bottom of the slider mechanism opposite the top wall.

7. The slider mechanism of claim 6 further comprising a second closure bar protruding laterally inwardly into the channel from a side thereof, wherein the second closure bar is longitudinally spaced from the first closure bar and is disposed between the retention member and the top wall.

8. The slider mechanism of claim 1, wherein the hinge member comprises a first sidewall connected to a second sidewall by a top wall, the first sidewall, second sidewall, and top wall defining a portion of the channel.

9. The slider mechanism of claim 1, wherein the first separator portion and the second separator portion are longitudinally spaced from the hinge portion.

10. The slider mechanism of claim 1, wherein the second separator portion is disposed between the first separator portion and the hinge portion.

11. The slider mechanism of claim 1 further comprising a lateral shoulder protruding from the first separator portion.

12. A closure assembly, comprising:

a first elongate closure member opposing a second elongate closure member complementary to the first elongate closure member; and a slider including a first separator portion and a second separator portion articulably separable from the first separator portion about an axis that is about perpendicular to an axis of the elongate closure members, the first separator portion and the second separator portion being disposed between the first elongate closure member and the second elongate closure member;

wherein the slider de-occludes the first elongate closure member from the second elongate closure member when urged in an opening direction thereon.

13. The closure assembly of claim 12, wherein the first separator portion is articulably separated from the second separator portion when the slider is urged in the opening direction.

14. The closure assembly of claim 13 further comprising an actuating lever extending from a hinge portion that defines the first said axis, wherein the hinge portion is disposed between the actuating lever and the first separator portion such that movement of the actuating lever in a first direction toward the elongate closure members is accompanied by movement of the first separator portion in a second direction opposite the first direction.

15. The closure assembly of claim 13, wherein the first separator portion and the second separator portion de-occlude the first elongate closure member from the second elongate closure mechanism.

16. The closure assembly of claim 12, wherein the first elongate closure mechanism includes a first interlocking profile spaced from a second interlocking profile, and wherein the second elongate closure mechanism includes a third interlocking profile opposite the first interlocking profile and a fourth interlocking profile opposite the second interlocking profile.

17. The closure assembly of claim 16, wherein the first separator member is disposed between the first interlocking profile and the third interlocking profile and is not disposed between the second interlocking profile and the fourth interlocking profile.

18. The closure assembly of claim 16, wherein the first separator member further comprises an outturned shoulder disposed between the first interlocking profile and the second interlocking profile.

19. The closure assembly of claim 12, wherein the first separator member is longitudinally displaced from the second separator member.

20. The closure assembly of claim 19, wherein the first separator member laterally overlaps with the second separator member in at least one position and is laterally spaced therefrom in a second position.

* * * * *